United States Patent [19]

Tsukamoto

[11] Patent Number: 5,056,491

[45] Date of Patent: Oct. 15, 1991

[54] APPARATUS FOR CONTROLLING AN AIR-FUEL RATIO IN AN INTERNAL COMBUSTION ENGINE

[75] Inventor: Keisuke Tsukamoto, Toyota, Japan

[73] Assignee: Toyota Jidosha Kabushiki Kaisha, Toyota, Japan

[21] Appl. No.: 504,252

[22] Filed: Apr. 4, 1990

[30] Foreign Application Priority Data

Apr. 11, 1989 [JP] Japan ..... 1-89855
Apr. 11, 1989 [JP] Japan ..... 1-89856

[51] Int. Cl.[5] ..... F02D 41/10

[52] U.S. Cl. ..... 123/492; 123/489; 123/308

[58] Field of Search ..... 123/492, 306, 308, 489

[56] References Cited

U.S. PATENT DOCUMENTS 4,598,678 7/1986 Kobayashi et al. ..... 123/306
4,682,577 7/1987 Kato et al. ..... 123/492
4,753,200 6/1988 Kawamura et al. ..... 123/306
4,841,937 6/1989 Nagaishi ..... 123/492

FOREIGN PATENT DOCUMENTS 59-34440 2/1984 Japan .

*Primary Examiner*—Andrew M. Dolinar
*Attorney, Agent, or Firm*—Kenyon & Kenyon

[57] ABSTRACT

An air-fuel ratio control system in an internal combustion engine, whereby an acceleration condition is detected to obtain an enrichment correction of a fuel injection amount. An occurrence of a mild acceleration is detected by calculating a value of a rate of change in a parameter of an engine load, such as a degree of opening of a throttle value, between adjacent timings, accumulating values of the rate of change of the engine load parameter during a sampling period, and comparing the accumulated value with a predetermined threshold value.

14 Claims, 11 Drawing Sheets

| Fig. 7A | Fig. 7B |
|---|---|

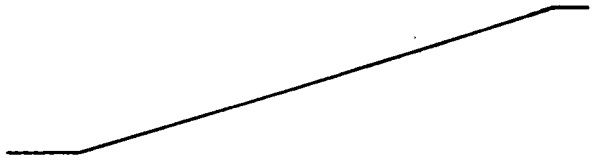
Fig. 9 a
(PRIOR ART)
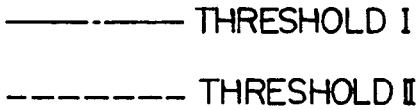
Fig. 9 b
(PRIOR ART)
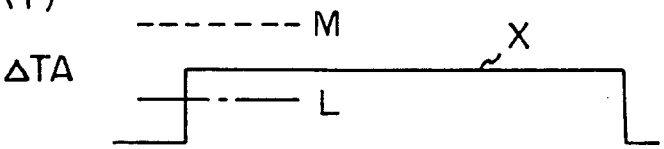

RAPID ACCELERATION
MILD ACCELERATION

TA
166
161

SDLTA
167
163
165
DLTA
16 ms
128ms
2
1
3
3'
4
4'

APPARATUS FOR CONTROLLING AN AIR-FUEL RATIO IN AN INTERNAL COMBUSTION ENGINE

BACKGROUND OF THE INVENTION

1. Field of the Invention

The present invention relates to an apparatus for controlling an air fuel ratio in an internal combustion engine.

2. Description of the Related Art

In a known device for controlling an air-fuel ratio in an internal combustion engine, an air-fuel ratio is controlled to a value in a lean zone when the engine is operating in a steady state condition, and to a theoretical air-fuel ratio or a value in a rich zone when the engine is under an accelerating condition. This type of air-fuel ratio control system is used to obtain both an increased fuel consumption efficiency and an increased engine output power, which are contradictory requirements.

In such a system, a change from a steady state condition to an accelerating condition is detected, and a setting of a value of an air-fuel ratio is switched from a lean side value to a rich side value. To detect a timing of the switching of the setting from an air-fuel ratio on the lean side to an air-fuel ratio on the rich side, engine load parameters such as an engine intake pressure and/or degree of opening of the throttle valve are detected, and rates of changes in the values of these engine load parameters are calculated. When an acceleration is determined from a large rate of change in the engine load, the air fuel ratio is switched from a lean setting to a rich setting, wherein the air-fuel ratio is equal to a theoretical air-fuel ratio or an air-fuel ratio on the richer side. To detect an acceleration condition, usually the rate of change of the degree of opening of the throttle valve is calculated, and then it is determined whether the rate of change of the degree of opening of the throttle valve is larger than a predetermined threshold value, and thus it is determined if a switch from the steady state condition to the acceleration condition, and vice versa, has occurred. To obtain a value of the air-fuel ratio which matches an acceleration requirement of the driver, not only a rapid acceleration but also a very slight acceleration must be precisely detected, and thus the air-fuel ratio is controlled in accordance with the detected degree of acceleration. Nevertheless, a precise and rapid detection of a mild acceleration is very difficult, for the following reason. To realize a rapid detection of the acceleration, it is necessary to shorten the timing at which the value of the degree of opening of the throttle valve is read as a parameter of the degree of load on the engine. Furthermore, to detect a very mild acceleration condition, it is necessary to lower the value of the threshold of the rate of change of the degree of the opening of the throttle valve, to determine the acceleration. Nevertheless, as well known, a steady state condition in an internal combustion engine does not always require a constant degree of opening of the throttle valve. Namely, small changes in the value of the degree of opening of the throttle valve frequently occur even when the engine is running under a steady state condition. This means that a small threshold value intended for a detection of the slightest acceleration makes it difficult to differentiate that acceleration from a change in the degree of opening of the throttle valve generated during the steady state condition, and thus the calculated speed of the change of the degree of opening of the throttle valve will exceed the threshold valve even if the engine is not in an acceleration condition but a steady state. This causes the setting of the air-fuel ratio to be changed to that for a high engine output, regardless of the driver's intention to maintain a steady state running, and such a rapid increase in the engine output power causes the driver to feel that the engine is in a state in which it should not be. The setting of a sufficiently large value of the threshold of the speed of change of the degree of opening of the throttle valve, to prevent this from happening, makes it impossible to detect a mild acceleration as desired, and thus the air-fuel ratio is not properly controlled.

Japanese Unexamined Patent Publication No. 63-129140 discloses a counter which is incremented when a value of a rate of change of the degree of opening of the throttle valve exceeds a predetermined value, and which is cleared to zero when the value of the rate of the change of the degree of opening of the throttle valve falls below the predetermined value. The acceleration operation is differentiated from the steady state condition by determining whether or not the value of the counter exceeds a predetermined value.

Nevertheless, this prior art of Japanese Unexamined Patent Publication No. 63-129140 suffers from a drawback in that a quick detection of a mild acceleration is difficult, for the following reason. When the engine is under a mild acceleration condition, the condition at which the rate of change of the degree of the opening of the throttle valve is larger than a predetermined value is not always maintained, and therefore, a situation may frequently occur wherein a rate of change of the degree of opening of the throttle valve falls below said predetermined value, due, for example, to the occurrence of noise by which the counter is cleared. As a result, it is difficult for the counter to obtain the threshold value and determine an acceleration, causing a delay in the detection of the acceleration. This means that there will be a delay in a change in the setting of the air-fuel ratio with respect to the mild acceleration requirement by the driver, causing the engine output torque to be "unnaturally" changed and worsening the driveability.

SUMMARY OF THE INVENTION

An object of the present invention is to provide an apparatus capable of detecting a mild acceleration condition which can be discriminated from a fluctuation of a load during a steady running condition of an internal combustion engine.

According to the present invention, an internal combustion engine is provided, which comprises:

an engine body;

an intake system connected to the engine body for an introduction of a combustible mixture to the engine body;

an exhaust system connected to the engine body for a removal of resultant exhaust gas from the engine body;

means for controlling an air-fuel ratio of the combustible mixture in the intake system;

first air-fuel ratio setting means for setting the air-fuel ratio to the lean side;

second air-fuel ratio setting means for setting the air-fuel ratio to obtain a required engine power;

means for detecting a load of the engine;

first calculating means for calculating a rate of change in the engine load during a first period short enough to enable a detection of a change in the load during a slight acceleration;

second calculating means for calculating an accumulated value of a rate of change in the engine load during a period which is longer than the first period, and;

means for determining an acceleration operation of the engine based on the calculated accumulated value, and;

switching means for switching a connection of the air-fuel ratio control means from the lean air-fuel ratio setting means to said second air-fuel ratio setting means when an acceleration operation is determined.

BRIEF DESCRIPTION OF THE DRAWINGS

FIGS. 9*a* and 9*b* show a determination of an acceleration in the prior art;

DESCRIPTION OF THE PREFERRED EMBODIMENTS

Figure 1:
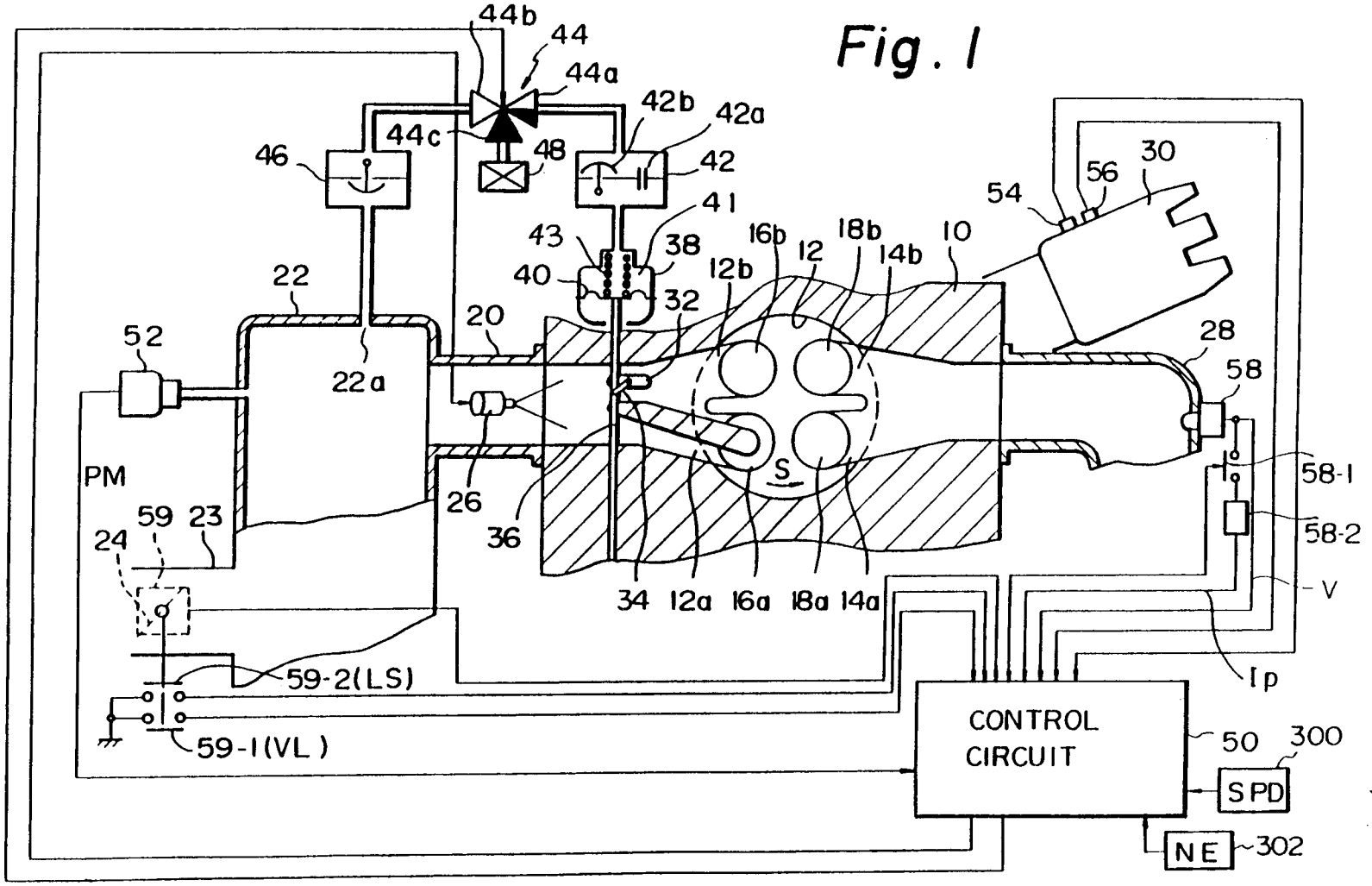
FIG. 1 shows a general view of an internal combustion engine according to the present invention.

In FIG. 1, showing a 4-valve type internal combustion engine according to the present invention, 10 denotes a cylinder block, 12 a cylinder bore, 12*a* and 12*b* intake ports, 14*a* and 14*b* exhaust ports, 16*a* and 16*b* two intake valves for intake ports 12*a* and 12*b*, respectively, and 18*a* and 18*b* two exhaust valves for exhaust ports 14*a* and 14*b*, respectively. The first intake port 12*a* is a helical shaped type capable of generating a swirl movement of intake air during an intake stroke of the engine, and the second intake port 12*b* is a straight type. The intake ports 12*a* and 12*b* are connected to a throttle body 23 via an intake pipe 20 and a surge tank 22. An injector 26 for each of the cylinders of the engine is arranged in the intake pipe 20, adjacent to the respective intake ports 12*a* and 12*b*, and the exhaust ports 14*a* and 14*b* are connected to an exhaust manifold 28. Reference numeral 30 denotes a distributor.

An intake control butterfly valve 32 is arranged in each of the straight type intake ports 12*b*, and when the intake control valve 32 is closed, the air from intake pipe 20 is introduced into the cylinder bore 12 only through the first helical shape intake port 12*a*, which generates a swirl movement of the intake air to allow a combustion of a super-lean combustible mixture, as will be fully describer later. Conversely, when the intake control valve 32 is open, the air from the intake pipe 20 is introduced into the cylinder bore 12 through both the first and second intake ports 12*a* and 12*b*, so that the swirl movement of the intake air is reduced. A lever 34 has one end connected to the respective intake control valve 32 and the other end connected to a rod 36. The rod 36 is commonly used for operating all of the intake control valves 32 of respective cylinders, and is connected to a vacuum actuator 38 provided with a diaphragm 40, a diaphragm chamber 41, and a spring 43. When the diaphragm chamber 41 is under an atmospheric pressure, the spring 43 urges the diaphragm 40 so that the rod 34 is moved downward and the intake control valve 32 is opened, as shown in FIG. 1. When the diaphragm chamber 41 is under a vacuum pressure, the diaphragm 40 is moved upward against the force of the spring 43 and thus the intake control valve 32 is closed. The diaphragm chamber 41 is connected, via a vacuum transmitting valve 42, an electro-magnetic three-way valve 44, and a check valve 46, to a vacuum port 22*a* in the surge tank 22. The vacuum transmitting valve 42 is constructed by an orifice 42*a* and a check valve 42*b*, in parallel with each other, for varying the speed of movement of the control valve 32 between the open state and the closed state thereof. The check valve 46 maintains a vacuum pressure in the diaphragm chamber 41, to hold the intake control valve 32 in the closed position when the vacuum level in the intake pipe, which has once reached a value high enough to open the intake control valve 32, falls below that level. The electro-magnetic valve 44 has three ports 44*a*, 44*b* and 44*c* , and when the valve 44 is de-energized, the ports 44*a* and 44*b* are connected to each other so that the diaphragm chamber 41 is opened to the vacuum port 22*a*. When the valve 44 is energized, the ports 44*a* and 44*c* are connected to each other so that the diaphragm chamber 41 is opened to the atmospheric pressure (air filter 48). The electro-magnetic valve 44 is connected to a control circuit 50 for switching the intake control valve 32.

The control circuit 50 is constructed as a microcomputer system and controls the injectors 26 and electromagnetic valve 44 in accordance with the present invention. An intake pressure sensor 52 is mounted on the surge tank 22, to obtain an analog signal indicating an absolute intake pressure PM, and crank angle sensors 54 and 56 are mounted on the distributor 30. The first crank angle sensor 54 outputs a pulse signal at every rotation of 720 degrees of the crankshaft, as a reference signal, and the second crank angle sensor 56 outputs a pulse signal at every 30 degrees of rotation of the crankshaft, which signal is used for calculating an engine speed NE. An air-fuel ratio sensor 58 is a lean sensor having a solid electrolyte body on which electrodes are formed, and a porous layer formed on the electrodes through which a controlled diffusion of particles of oxygen is allowed for generating a limit electric current, which allows a detection of the air-fuel ratio over a wide range and is located not only on the lean side but also on the rich side. The construction of this type of sensor is well known, and therefore, a detailed explanation thereof will be omitted. Furthermore, according to the present invention, a switching circuit is provided to allow the air-fuel ratio sensor 58 to operate as an oxygen density cell (i.e., $0_2$ sensor) when the air-fuel ratio is to be controlled to a theoretical air-fuel ratio, and to operate as the limit electric current sensor when the air-fuel ratio is to be controlled to an air-fuel ratio other than the theoretical air-fuel ratio. The switching circuit is constructed by a switch 58-1 and a limit electric current detecting circuit 58-2, which are connected to the sensor 58. When the switch 58-1 is made OFF, the sensor 58 detects an electromotive force V, which allows a discrimination of whether or not the air-fuel ratio is higher than the theoretical air-fuel ratio. When the sensor 52 is to be operated as the limit electric current sensor, the switch 58-1 is made ON and the limit electric current detecting circuit 58-2 acts as a control circuit to obtain an application of a constant electric voltage thereto by varying an electric current $I_p$, which is a pumping current in the sensor 58.

A throttle sensor 59 is connected to the throttle valve 24 to detect a degree of opening of the throttle valve 24 over the entire range of the degree of opening thereof. The throttle sensor 59 is provided with switches 59-1 and 59-2 for detecting fixed degrees of opening of the throttle valve 24. The switch 59-1 is a high load degree of opening switch (VL switch) which is usually OFF but is made on when the throttle valve 24 is opened to a degree which corresponds to a high engine load, for example, at 70 percent of a full opening of the throttle valve. The lean switch 59-2 (LS switch) is also usually OFF but is made ON when the throttle valve 24 is opened to a degree which corresponds to a medium engine load, for example, 62.5 percent of a full opening of the throttle valve 24. The control circuit 50 carries out programmed routines in accordance with signals received from these sensors, to operate the injectors 26 and the electro-magnetic valve 44.

Figure 2:
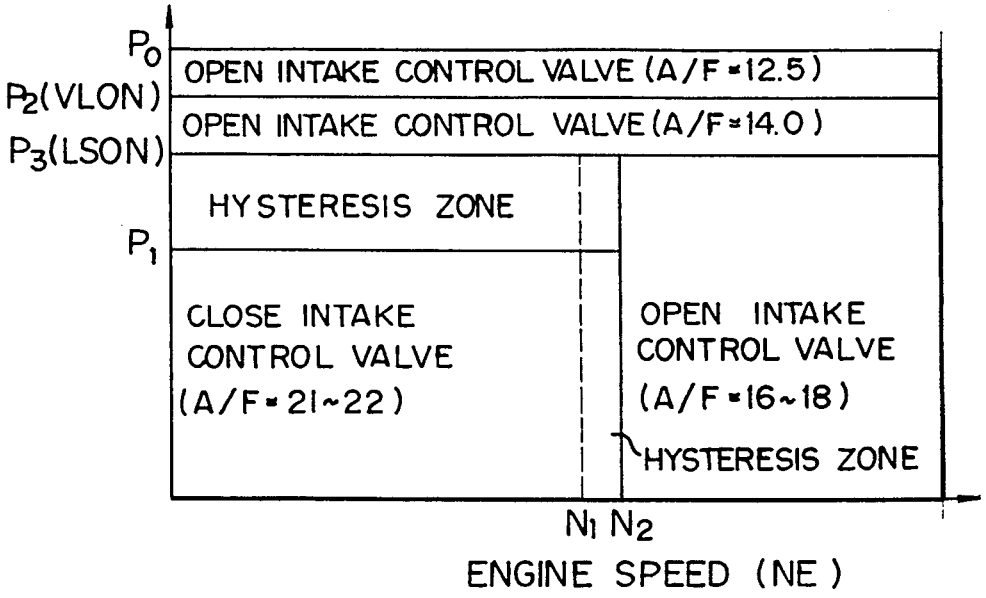
FIG. 2 is a diagrammatic view showing a control map of the intake control valve according to the present invention.

FIG. 2 shows the construction of a base control map used a for controlling the intake control valve 32. When the engine is under a low load and low speed condition of which the intake pressure $PM<P_3$ (corresponding to a point at which the lean switch (LS) 59-2 is switched between the ON and OFF positions) and the engine speed $NE \leqq N2$ , the intake control valve 32 is closed. When the engine is in a low load and high speed condition at which $PM<P_3$ and $NE>N_2$, the intake control valve 32 is opened. It should be noted that a value of $P_1$of the intake pressure is the highest value of the intake pressure at which the intake control valve 32 is kept closed, but when the intake pressure exceeds the value $P_1$and approaches the value $P_3$, the check valve 46 maintains the pressure in the actuator diaphragm chamber 41 at this pressure value $P_1$ to keep the intake control valve 32 closed. When the intake pressure has once exceeded the value $P_3$ and then falls the value $P_1$, the pressure in the chamber 41 is not sufficient to open the intake control valve 32, because the check valve 46 is now open. Accordingly, the intake control valve 32 is kept open when a once obtained pressure in the area where $PM \geqq P_3$ falls to the area where $P_1<PM<P_3$ during a deceleration condition. This area $P_1<PM<P_3$ for opening the intake control valve 32 is a hysteresis zone wherein the control of the intake control valve 32 is changed when the intake pressure rises into the hysteresis zone and when the intake pressure falls into the hysteresis zone. When the intake pressure falls to a region where $PM \leqq P_1$, the intake control valve 32 is closed. When the engine speed is reduced to a zone where $N_1<NE \leqq N_2$, the intake control valve 32 is kept open, and after the engine speed drops to a region where $NE \leqq N_1$, the intake control valve 32 is closed. Namely, a hysteresis zone is also provided for the engine speed.

Figure 3:
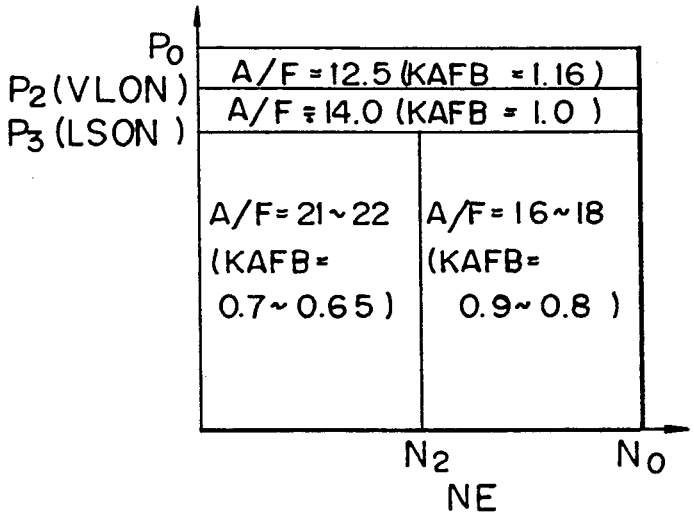
FIG. 3 is a diagrammatic view showing a control map of the air-fuel ratio according to the present invention.

FIG. 3 is a map for the control of the air-fuel ratio. When the engine is under a low load and low speed condition $PM<P_3$ and $NE \leqq N_2$, in which the intake control valve 32 is closed, the setting of the air-fuel mixture is overlean when the air-fuel ratio is between 21 to 22. This setting is determined from the values of the engine speed and intake pressure, using a map. When $PM<P_3$ and $NE>N_2$, i.e., the engine is under a low load and high speed condition and the intake control valve 32 is opened, the air-fuel mixture is in a medium lean state in which the air-fuel ratio is between 16 and 18. This setting is also determined from the values of the engine speed and intake pressure, by using a map. When the engine is in a state where $P_3 \leqq PM<P_2$, and thus the intake control valve is opened and the air-fuel ratio is set to the theoretical air-fuel ratio. Furthermore, when the engine is under the full load state where $PM \geqq P_2$, the air-fuel mixture is made richer than the theoretical air-fuel ratio, for example, 12.5. It should be noted that, when the engine is accelerating, the air-fuel ratio is controlled to a theoretical air-fuel ratio even if the engine is in a condition corresponding to the lean or overlean mixture state. Furthermore, in the above-mentioned hysteresis state where $P_1<PM<P_3$, the air-fuel ratio is controlled to the theoretical air-fuel ratio. It should be also be noted that $P_0$ in FIGS. 2 and 3 corresponds to a value of the intake pressure PM when the throttle valve 24 is fully open.

Figure 4:
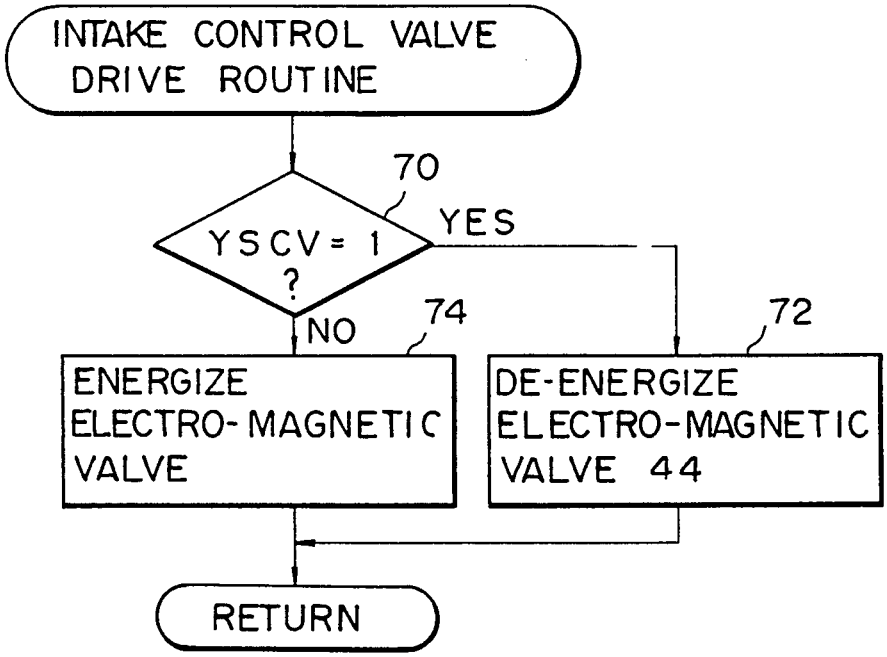
FIGS. 4, 5, 6, 7, 7A, 7B and 8 are flow charts for realizing an operation according to the present invention.

The operation of the control circuit 50 for realizing the setting of the maps in FIGS. 2 and 3 will be now described with reference to the flowcharts. FIG. 4 shows a routine for controlling the intake control valve 32, which routine can be located in the main routine. At step 70 it is determined if YSCV is 1. This flag YSCV is an intake control valve control flag, which is set or reset by the execution of a routine described later. When YSCV is 1, the routine goes to step 72 where a signal is output to de-energize the electro-magnetic valve 44. As a result, the electromagnetic valve 44 is in a position at which the common port **44*a* is connected to the first switching port 44*b*, so that the vacuum port 22*a* is opened to the diaphragm chamber 41 via the check valve 46 and the vacuum transmitting valve 42, causing the diaphragm 40 to be moved upward against the spring 43 in FIG. 1 until the intake control valve 32 is closed. It should be noted that the check valve 46 can maintain a vacuum pressure in the diaphragm chamber 41, which pressure is sufficient to open the intake control valve 32 even if the vacuum level in the intake pipe 20 is weakened because the throttle valve 24** is further opened.

When it is determined that YSCV is 0 at step 70, the routine goes to step 74 where a signal is output to energize the electromagnetic valve 44. As a result, the electromagnetic valve 44 is in a position at which the common port **44*a* is connected to the second switching port 44*c*, so that the air cleaner 48 is opened to the diaphragm chamber 41, causing the atmospheric air to be introduced into the diaphragm chamber 41 via an orifice of the vacuum transmitting valve 42 and the diaphragm 40 to be moved downward by the spring 43 in FIG. 1 until the intake control valve 32 is opened. The orifice controls the speed of the opening of the intake control valve 32**.

Figure 5:
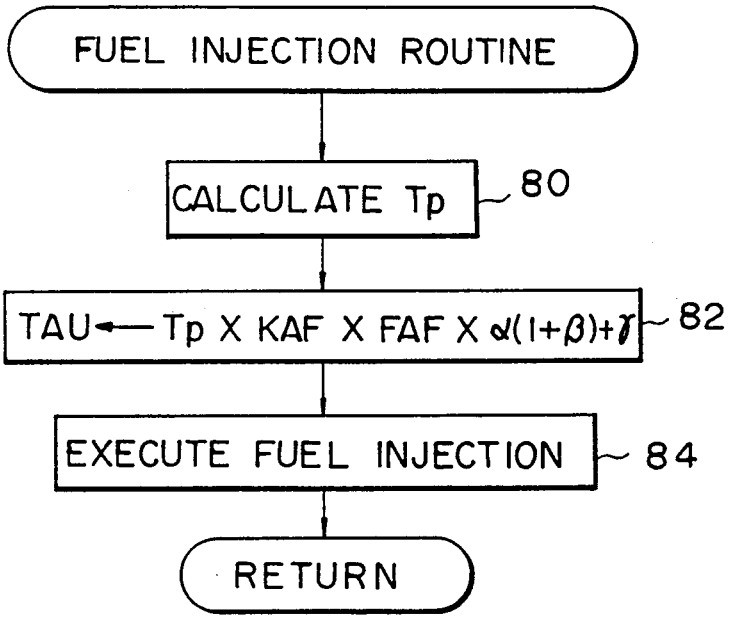

FIG. 5 is a fuel injection routine which is executed when a predetermine of the crankshaft is detected by the crank angle sensors 54 and 56, which is located slightly before the crank angle position for the execution of the fuel injection routine. At step 80, a basic fuel injection amount $T_p$ is calculated. This is determined in accordance with the intake pressure PM corresponding to the engine load and engine speed NE, to obtain the theoretical air-fuel ratio. At step 82, a final fuel injection amount TAU is calculated by $$TAU=T_p \times KAF \times FAF \times \alpha \times (1 \times \beta)+\gamma$$

where KAF is an air-fuel ratio correction factor which is calculated by the execution of a routine in FIG. 7, to obtain a corrected air-fuel ratio which is located on the rich or lean side of the theoretical air-fuel ratio obtained by the basic fuel injection amount $T_p$, as will be explained with reference to FIG. 7. The FAF is a feedback correction factor which is controlled so that an air-fuel ratio detected by the air-fuel ratio sensor 58 conforms to the target air-fuel ratio. Here $\alpha$, $\beta$ and $\gamma$ generally designate correction factors or correction amounts for correcting the amount of fuel to be injected. At step 84, a fuel injection is executed by generating an injection signal to be output to a fuel injector 26 of one designated cylinder of the engine, to inject the amount of fuel calculated at step 82.

Figure 6:
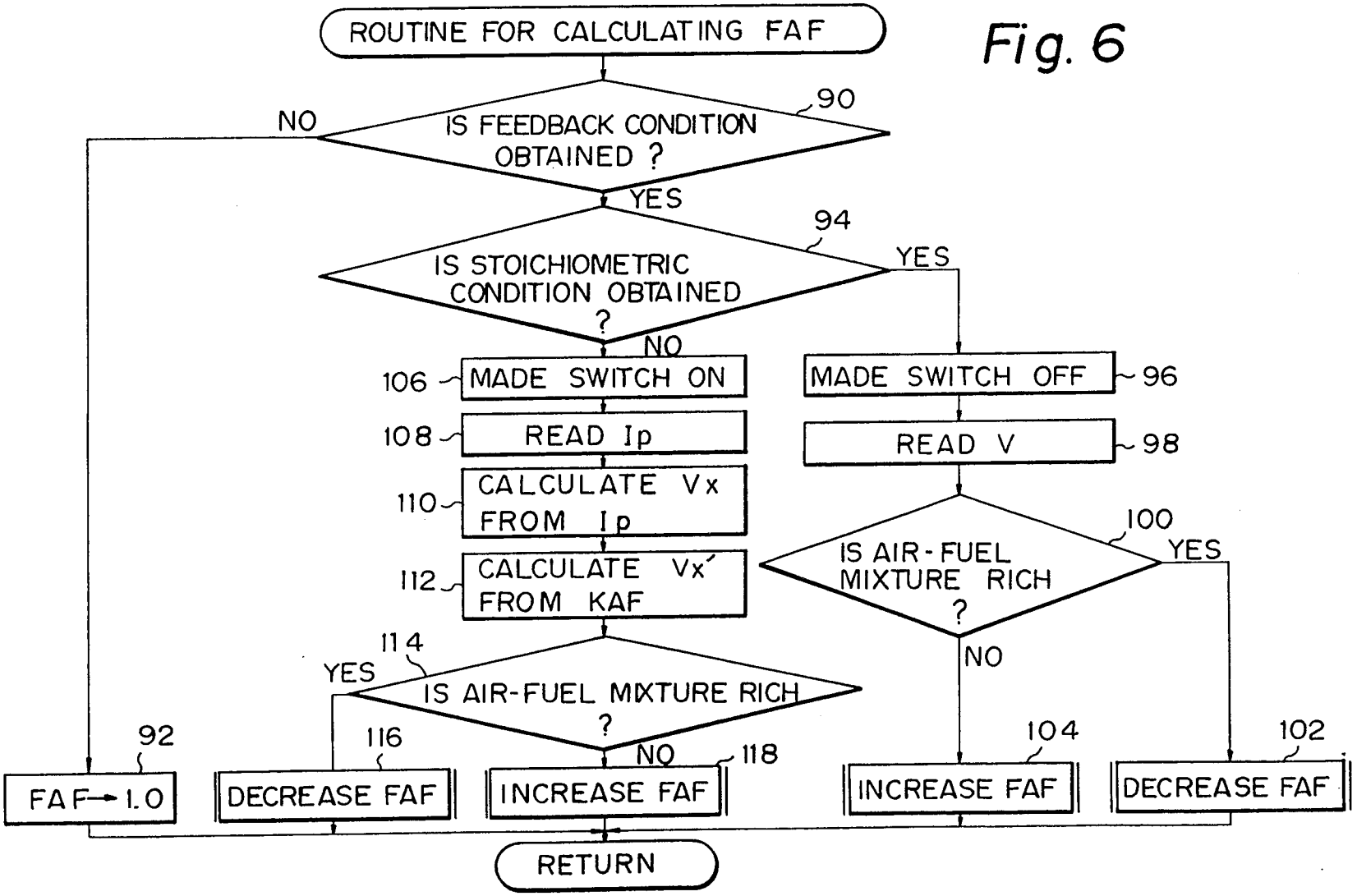

FIG. 6 is a routine for calculating the feedback correction factor FAF. This routine is executed at predetermined intervals for example, every 32 milliseconds. At step 90, it is determined if a feedback condition for executing an air-fuel ratio feedback control is obtained. When it is determined that the engine is under a non-feedback condition, e.g., an engine starting mode, the routine goes from step 90 to step 92, where a value of 1.0 is moved to the FAF. When it is determined that the air-fuel ratio feedback control is obtained, the routine from step 90 to step 94, where it is determined whether a condition is obtained wherein the air-fuel ratio is to be controlled to the theoretical air-fuel ratio (stoichiometric air-fuel ratio). When it is determined that the stoichiometric condition is obtained, the routine goes from step 94 to step 96, where the switch 58-1 is made OFF and thus the air-fuel ratio sensor 58 operates as an $0_2$ sensor. At step 98, a value of the electromotive force $\underline{V}$ of the sensor 58 is detected, and at step 100 it is determined if the air-fuel mixture is rich, by determining whether the output voltage level $\underline{V}$ from the $0_2$ sensor 58 is larger than a predetermined threshold value. When it is determined that the sensor output voltage level e,uns/V/ is larger than the threshold value, the routine goes from step 100 to step 102, where a routine is carried out for lowering the value of the feedback correction factor FAF. When it is determined that the sensor output voltage level e,uns/V/ is lower than the threshold value, the routine goes from step 100 to step 104, where a routine is carried out for increasing the value of the feedback correction factor FAF. As is well known, this process for controlling the feedback correction factor FAF includes a proportional control (skip control) and an integration control. These are well known, and therefore, a detailed explanation thereof will be omitted.

When it is determined at step 94 that the stoichiometric condition is not obtained (the output level of the air-fuel ratio sensor 58 as an $0_2$ sensor is lower than the threshold value), the routine goes to step 106 where the switch 58-1 is made ON and thus the air-fuel ratio sensor 58 operates as a lean sensor. At step 108, a pumping current $I_p$ controlled by the pumping current control circuit 58-2 is read out, and at step 110, a value of the parameter $V_x$ for converting the pumping electric current to the air-fuel ratio is calculated. Then at step 112, a value of a parameter $V_x'$ for the conversion of the air-fuel ratio feedback control factor FAF to the air-fuel ratio is calculated. This value $V_x'$ is a target value of the air-fuel ratio in the form of the output level of the air fuel ratio sensor 58 as the lean sensor. At step 114, it is determined if the air-fuel mixture is rich, based on a comparison of the values $V_x$ and $V_x'$. It should be noted that, in the limit electric current type sensor, the leaner the air-fuel mixture the larger the electric current, and the richer the air-fuel mixture the smaller the electric current. Therefore, a condition $V_x > V_x'$ means that the actual air-fuel ratio is deviated to the lean side with respect to the target air-fuel ratio, and a condition $V_x < V_x'$ means that the actual air-fuel ratio is deviated to the rich side. When it is determined at step 114 that the air-fuel mixture is deviated to the rich side, the routine goes to step 116, where a routine is carried out for lowering the value of the feedback correction factor FAF. When it is determined at step 114 that the air-fuel mixture is deviated to the lean side, the routine goes to step 118, where a routine is carried out for increasing the value of the feedback correction factor FAF. As in steps 102 and 104, the controls in steps 116 and 118 include a well known proportional control (skip control) and an integration control of the feedback correction factor.

Figures 7, 7A:
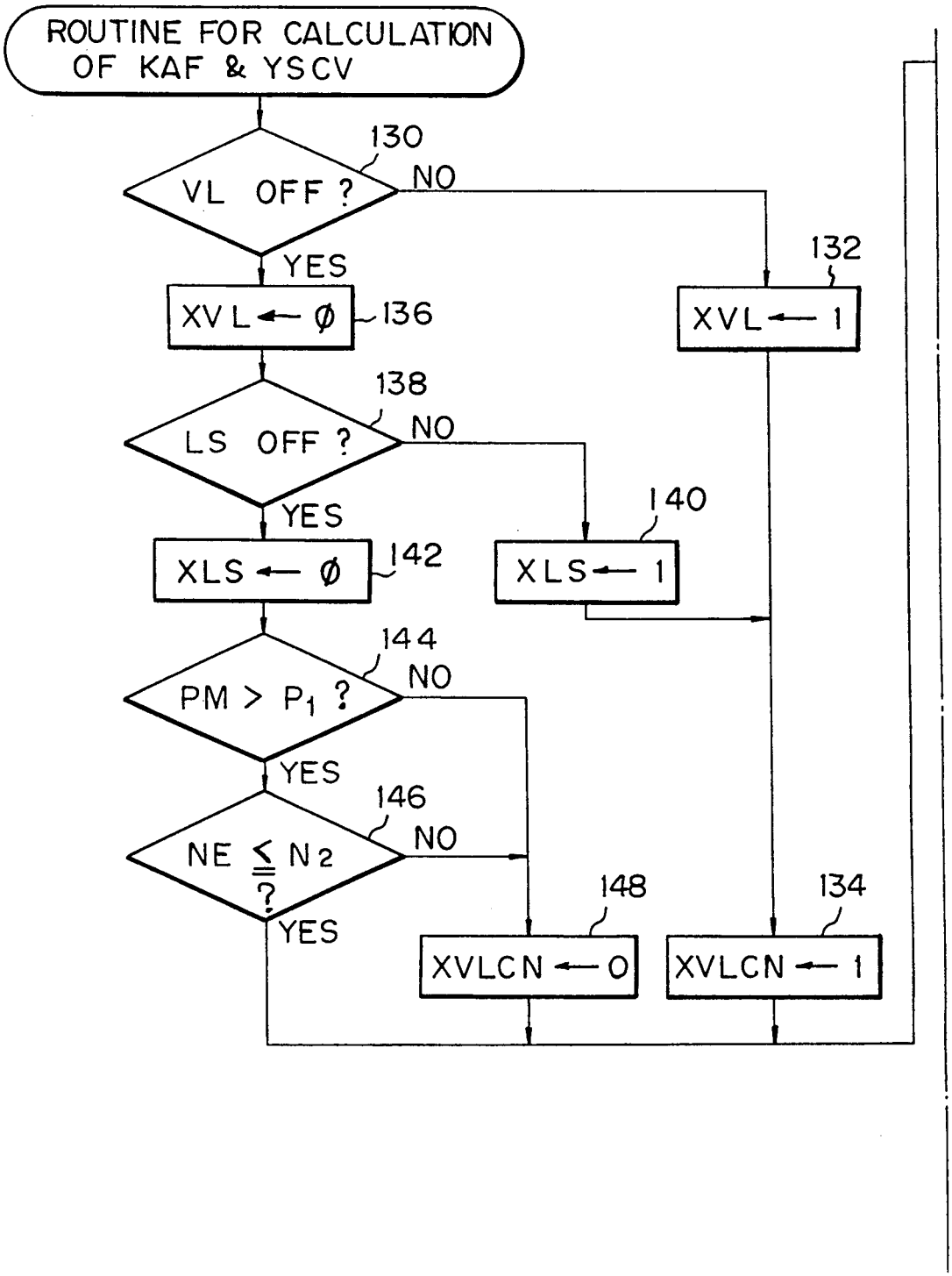
Figure 7B:
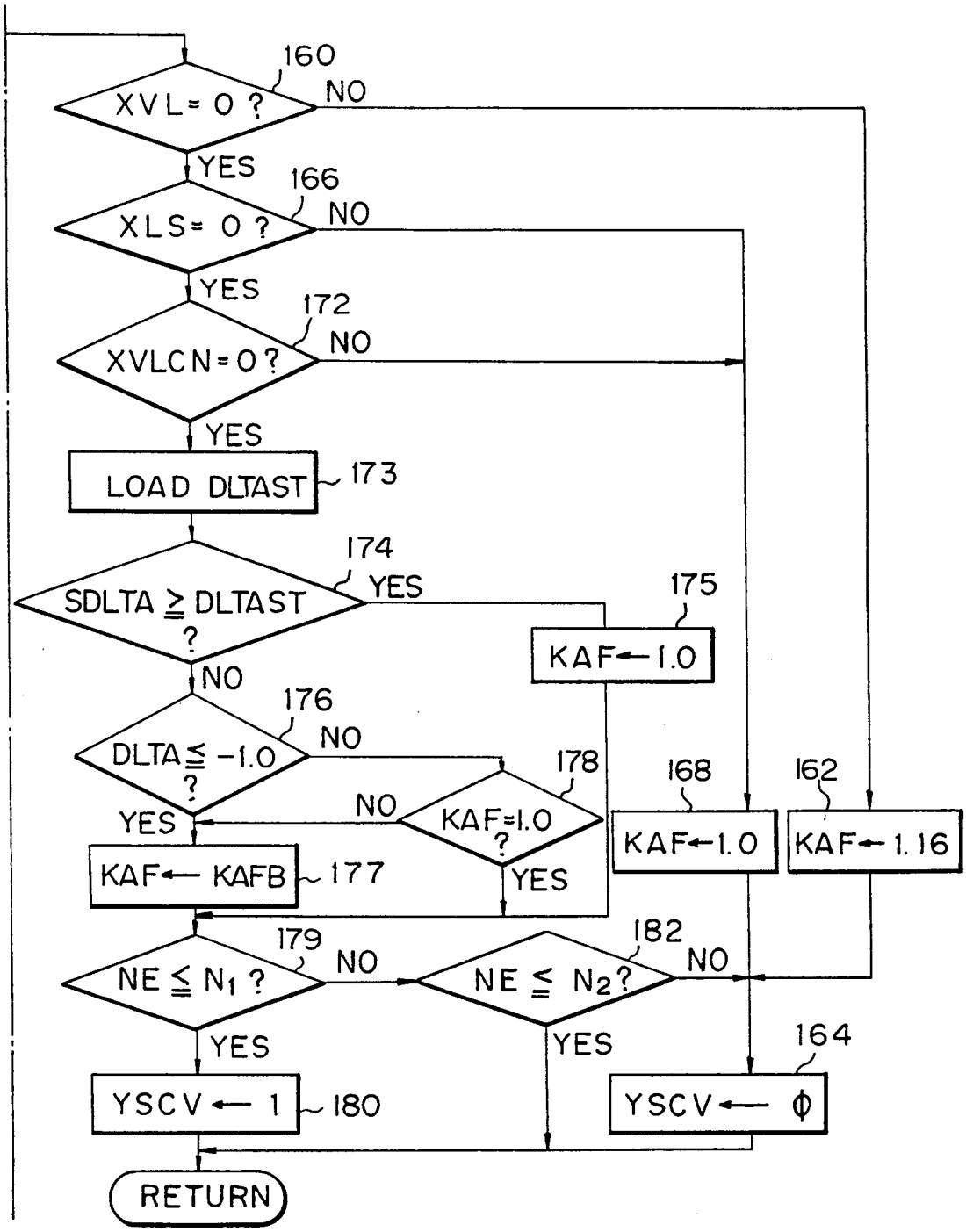

FIG. 7 shows a routine for calculating a correction factor and flags used in the routines in FIGS. 4 to 6. Steps 130 to 148 are concerned mainly with a control of a hysteresis flag. At step 130, it is determined if the throttle valve wide open switch (VL switch) 59-1 is made OFF, i.e., the degree of opening of the throttle valve 24, which is an indication of an engine load, is smaller than a predetermined value corresponding to the intake pressure PM, which is equal to $P_2$ in FIG. 2. When it is determined that the VL switch 59-1 is made ON, i.e., the engine is under a high load, the routine goes to step 132 where a flag XVL is set (1), and to step 134 where a flag XVLCN is set. The flag XVL shows whether the VL switch 59-1 is ON or OFF, and the flag XVLCN is used for attaining a hysteresis operation such that a return to the lean control is prevented until the intake pressure PM is lowered to a level ($P_1$), which is sufficient to cause the diaphragm 40 to be moved upward against the force of the spring 43 to close the intake control valve 32, when the intake pressure PM, which once exceeded the threshold value $P_3$ for opening the intake control valve 32 during the increase of the intake pressure PM, again falls below the threshold value $P_3$ toward the value $P_1$. When it is determined that the VL switch 59-1 is OFF at step 130, the routine goes to step 136 and the flag XVL is reset (O).

At step 138, it is determined if the lean switch (LS switch) 59-2 is made OFF, i.e., the degree of opening of the throttle valve 24 as a parameter indicating the engine load is smaller than a predetermined value, which corresponds to a value of the intake pressure PM, which is equal to $P_3$ in FIG. 2. When it is determined that the lean switch 59-2 is made ON, the routine goes to step 140 where a flag XLS is set and then to step 134 where the flag XVLCN is set (1). The flag XLS shows whether the lean switch 59-2 is ON or OFF. When it is determined that the lean switch 59-2 is made OFF at step 138, the routine goes to step 142 and the flag XLS is reset (O).

At step 144 it is determined if the intake pressure PM is larger than a predetermined value $P_1$, and at step 146 it is determined if the engine speed NE is equal to or smaller than a predetermined value $NE_2$ When it is determined that $PM \leqq P_1$, the routine goes to step 148 and the flag XVLCN (hysteresis flag) is reset. Therefore, an overlean air-fuel mixture is obtained as long as the engine is in a steady running state. Furthermore, when $PM > P_1$ and $NE > N_2$, the flag XVLCN is cleared at step 148, and therefore, the intake control valve 32 is opened and the air-fuel ratio is kept in a slightly lean zone as long as the engine is in the steady running state. When $PM > P_1$ and $NE \leqq N_2$, which is the hysteresis zone, the routine 148 is by-passed so that the value of the flag XVLCN is maintained as is.

The routine following step 160 is related to the control of the air-fuel ratio correction factor KAF and intake control valve condition flag YSCV. At step 160, it is determined if XVL is O, i.e., the VL switch 59-1 is OFF; namely, the degree of opening of the throttle valve 24 is smaller than a degree of opening corresponding to the intake pressure PM having the value $P_2$ in FIG. 2. When it is determined that XVL=1, i.e., the degree of opening of the throttle valve 24 is larger than a degree of opening corresponding to the intake pressure PM having the value $P_3$, the routine goes to step 162 where an air-fuel ratio correction factor KAF is loaded with a value 1.16. This value of the air-fuel ratio correction factor KAF is determined with respect to the basic fuel injection amount $T_p$ at step 80 in FIG. 5, in such a manner that the air-fuel ratio corrected by KAF is equal to an air-fuel ratio having a value of, e.g., 12.5, in an engine high load operation. At step 164, YSCV is loaded by a value 0, so that the execution of the routine 4 causes the electro-magnetic valve 44 to be de-energized at step 72 in FIG. 4, causing the intake control valve 32 to be opened, as will be seen from the diagram.

When it is determined the XVL is 0, i.e., the degree of opening of the throttle valve 24 is smaller than a degree of opening corresponding to the intake pressure PM having a value $P_2$, the routine goes from step 160 to step 166 where it is determined if the flag XLS is 0, i.e., the degree of opening of the throttle valve 24 is smaller than predetermined degree of opening corresponding to the intake pressure PM having the value $P_3$ When it is determined that XLS=1, i.e., the degree of opening of the throttle valve is within a range of an intake pressure of between $P_2$ and $P_3$, the routine goes to step 168 where the air-fuel ratio correction factor KAF is loaded by a value 1.0, as will be seen from the map in FIG. 2. As a result, the air-fuel ratio as corrected by KAF is equal to that obtained by the basic fuel injection amount $T_p$ at step 80 in FIG. 5, i.e., the stoichiometric air-fuel ratio (for example 14.0). As already explained with reference to step 96 in FIG. 6, when the KAF=1, i.e., the air-fuel ratio is to be controlled to the stoichiometric air-fuel ratio, the air-fuel ratio sensor 58 functions as an $O_2$ sensor. Then the routine goes to step 164 to reset the flag YSCV and open the intake control valve.

When it is determined that XLS is 0, i.e., the degree of opening of the throttle valve 24 is smaller than the degree of opening corresponding to the intake pressure PM having the value $P_3$, the routine goes to step 172 where it is determined if the flag XVLCN=0. A value 1 of this flag XVLCN means that the intake pressure PM has once exceeded the value of $P_3$and has again fallen below this value $P_3$, where the value of the vacuum in the diaphragm chamber 41 is not sufficient to cause the intake control valve 32 to open against the force of the spring 43. In this case, the routine flows to the previously mentioned steps 168 and 164, to maintain the stoichiometric air-fuel ratio the intake control valve in the open position.

When it is determined at step 172 that the flag XVLCN is 0, i.e., the intake pressure PM is smaller than $P_1$or engine speed NE is smaller than $NE_2$, the routine goes to step 173 where a threshold value DLTAST for determining an acceleration and prohibiting a lean control is obtained. In this embodiment, the threshold value DLTAST is a fixed value of 7.5 degrees. At the following step 174, it is determined if an accumulation value of the rate of the change in the degree of opening of the throttle valve 24, SDLTA, is larger than the threshold value DLTAST having the value of 7.5 degrees. This SDLTA indicates the degree of acceleration, as will fully described later. If the value of SDLTA is larger than 7.5 degrees, this means that the engine is under an acceleration condition, and the routine then goes to step 175 where a value of 1.0 is moved to the KAF, so that the air-fuel ratio is controlled to the stoichiometric value, and then goes to step 179 described later.

When it is determined that the SDLTA is smaller than 7.5 degrees, the routine goes to step 176 where it is determined if the differential value of the degree of opening of throttle valve between adjacent timings, DLTA, is smaller than a predetermined minus value, e.g., −1.0. If the value of the DLTA is smaller than −1.0, this means that the throttle valve opening degree TA is becoming smaller, i.e., the engine is in a decelerating condition, and the routine goes to step 177. At step 177, the air-fuel ratio correction factor is calculated from the map KAFB, which is constructed as shown in FIG. 3. As will be seen from FIG. 3, the KAFB is divided into two portions in accordance with an engine speed; one portion being for an engine speed NE which is smaller than $N_2$, wherein the values of the KAFB are determined in accordance with the combination of the intake pressure PM and engine speed NE between 0.7 to 0.65, so that the air-fuel ratio is controlled in an over-lean zone between 21 to 22. The other map portion is for an engine speed NE which is higher than $N_2$, wherein the values of the KAFB are determined in accordance with the combination of the intake pressure PM and engine speed NE between 0.9 to 0.8, so that the air-fuel ratio is controlled in a intermediate lean zone between 16 to 18.

When it is determined that DLTA > −1.0 at step 176, it is considered that the engine is in a steady running state, and the routine goes to step 178 where it is determined if KAF=1.0. If KAF=1.0 at step 178, the air-fuel ratio is controlled to the stoichiometric air-fuel ratio at the preceding cycle, and thus the engine is still in an acceleration state, and thus the routine 177 is by-passed to maintain the stoichiometric air-fuel ratio. If KAF is not equal to 1.0 at step 178, the air-fuel ratio is controlled to the lean value at the preceding cycle, and thus the engine acceleration requirement has decreased. Accordingly, the routine goes to step 177, to maintain the lean air-fuel ratio calculated from the map KAFB, and then goes to step 179.

At step 179 it is determined whether the engine speed NE is equal to or smaller than the predetermined value $N_1$. When $NE \leqq N_1$, the routine goes to step 180 where the flag YSCV is set (1), and therefore the intake control valve 32 is closed, as shown by the map in FIG. 2, and the air-fuel ratio is controlled to a super lean value of between 21 to 22 in accordance with the values of the engine speed NE and intake pressure PM.

When it is determined that $NE > N_1$ at step 179, the routine goes to step 182 where it is determined if the engine speed is equal to or smaller than a predetermined value $N_2$. When it is determined that the engine speed NE is larger than the predetermined value $N_2$at step 182, the routine flows to step 164, where the flag YSCV is set (0), so that the intake control valve 32 is opened, as shown by the map in FIG. 2, and the air-fuel ratio is controlled to the mild lean value of between 16 to 18, in accordance with the combined values of engine speed NE and intake pressure PM as shown by the map in FIG. 3.

When it is determined that the engine speed $NE \leqq N_2$ at step 182, step 180 is bypassed and the value of the flag YSCV is maintained. Accordingly, during the increase in the value of the engine speed NE, the intake control valve 32 is switched from the closed position to the open position when the engine speed is equal to or larger than the predetermined value $N_2$. Conversely, during the decrease in the engine speed NE, the intake control valve 32 is kept open even if the engine speed is falls below the threshold value $N_2$, until the engine speed falls to $N_1$. Namely, during the falling of the engine speed, at an engine speed between $N_1$ to $N_2$ the intake control valve 32 is kept open, and is closed when the engine speed falls below the predetermined value $N_1$. Therefore, a hysteresis characteristic of the intake control valve is also provided in relation to the operation of the intake control valve 32.

Figure 8:
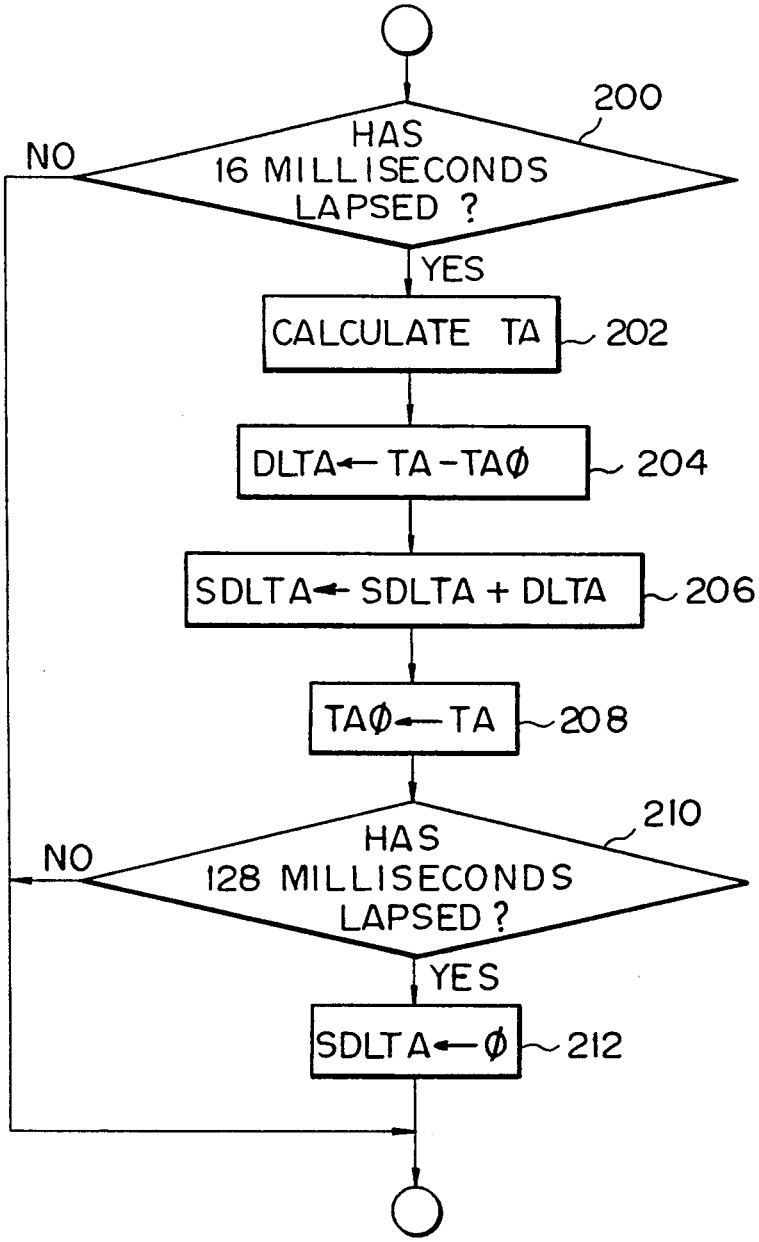

FIG. 8 shows a routine for calculating an accumulated value of a rate of change in the degree of opening of the throttle valve 24, SDLTA, which corresponds to an acceleration requirement. This routine is carried out in the main routine. First, at step 200, it is determined if a predetermined first or small period, such as 16 milliseconds, has elapsed from the preceding execution of the steps following step 202. When it is determined that 16 milliseconds have elapsed, the routine goes to step 202, where the degree of the opening of the throttle valve 24, TA, sensed by the throttle sensor 59 is read out. At the following step 204, a change in the throttle opening DLTA is calculated as the throttle opening degree TA obtained at step 202 by subtraction from the previous throttle opening degree TA0 obtained when the routine 202 was executed at the preceding timing earlier by 16 milliseconds than the present timing. At step 206, the counter SDLTA for storing the accumulation value of the rate of change of the degree of opening of the throttle valve 24 is incremented by DLTA. At step 208, the value of TA obtained at the step 202 is moved to TA0 for the calculation of DLTA at the following timing at step 202. At step 210, it is determined if a predetermined second larger period, such as 128 milliseconds, has elapsed from the preceding execution of a step following step 212. When it is determined that 128 milliseconds have elapsed, the routine goes to step 212 and the SDLTA is cleared. Namely, the SDLTA executes, for the period of 128 milliseconds (step 210), an accumulation of the values of the throttle opening degree change rate DLTA obtained at intervals of 16 milliseconds (step 200). The accumulated value SDLTA is used to determine the acceleration of the engine at step 174 in FIG. 7 by which a mild acceleration can be precisely detected. The discussion below will be directed to this point.

The most usual and conventional way of determining an acceleration requirement includes a calculation of the change in the degree of opening of the throttle valve or in the value of the intake pressure during a predetermined short period, and a comparison of the detected change with respect to a threshold value. This conventional method is difficult to effect during a mild or slow acceleration, which requires a quick and precise detection thereof, which requirements are contradictory. When the degree of opening TA of the throttle valve 24 is changed as shown by a line in FIG. 9(*a*), FIG. 9(*b*) shows a rate of change DTA of the degree of opening of the throttle valve as calculated from the TA in FIG. 9(*a*). The calculated speed change rate is compared with a threshold value, to determine an requirement. When it is necessary to detect a slow or mild acceleration condition, the threshold value must be as small as that shown by a line L, which causes a drawback in that a slight change of the value of the degree of opening of the throttle valve, which is inevitable during a steady running condition of the engine, is erroneously detected as an acceleration condition. To combat this, a threshold value may be given a larger value, as shown by a line M in FIG. 9(*b*), but this makes it difficult to detect a mild acceleration condition because the threshold value cannot exceed the detected value X.

Figures 10A, 10B:
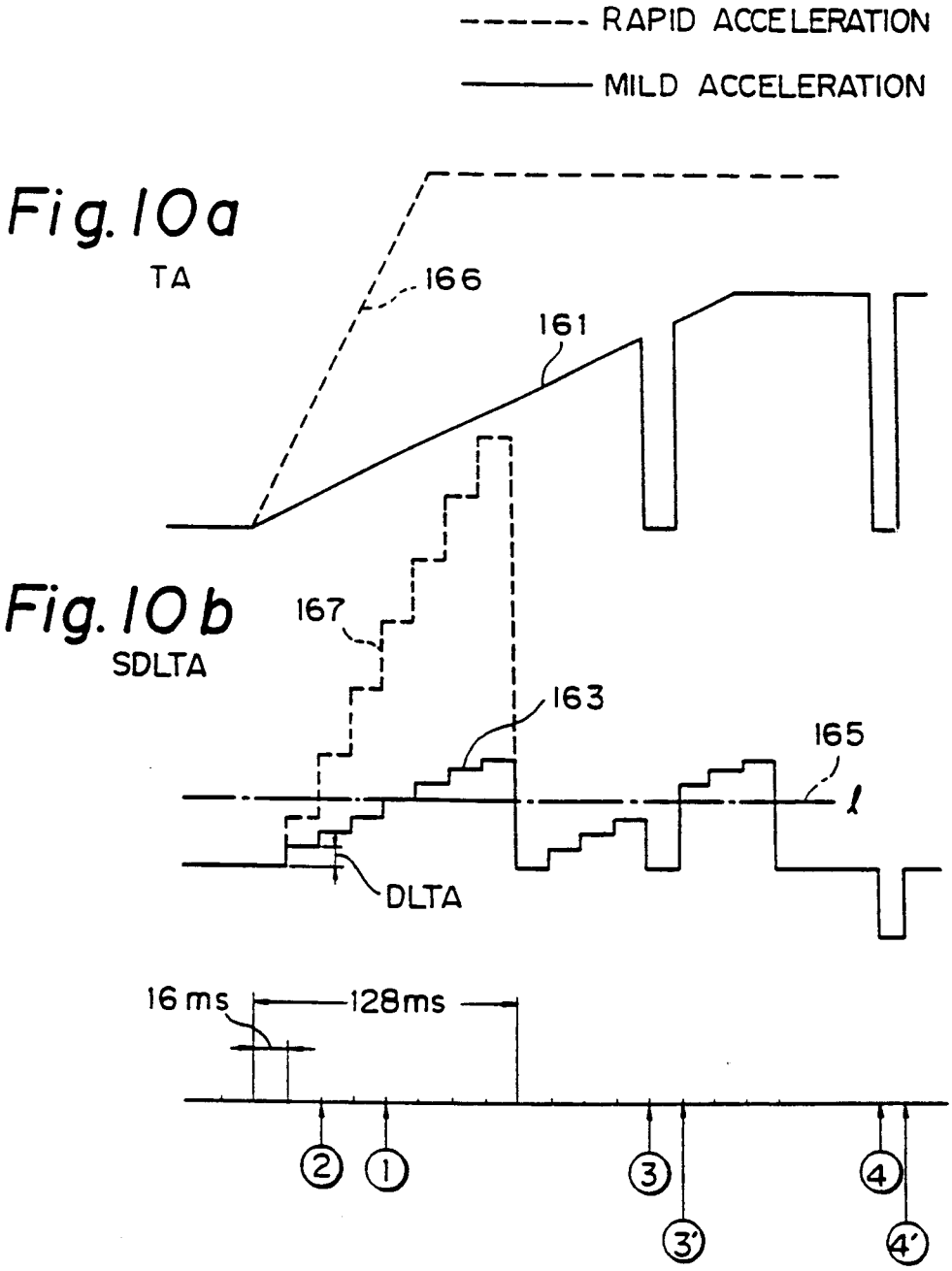
FIGS. 10(*a*) and 10(*b*) shows changes in a throttle opening degree TA and an accumulation value of the degree of change of the throttle opening SDLTA, during an acceleration of a vehicle; and, FIGS. 11 and 12 show routines for obtaining a threshold value of the changed throttle opening degree in other embodiments, respectively.

In view of above difficulty of the prior art, the present invention makes it possible to correctly and quickly detect a mild acceleration condition from an accumulated value SDLTA of change per time of a parameter of an engine load, as will be fully described hereinbelow. According to the present invention, the DLTA as a change of the degree of opening of the throttle valve 24 is first calculated at step 204 at short intervals of, for example, 16 milliseconds, as in step 200 of FIG. 8, which is sufficiently short to rapidly detect an acceleration requirement, then, the calculated throttle valve change amount DLTA is accumulated for, for example, 128 milliseconds in step 210, which period is longer than the sampling period of the DLTA (16 milliseconds) and which corresponds to a period wherein a continuous change of the degree of the opening of the throttle valve occurs during a mild acceleration condition, and finally, the accumulated value SDLTA is compared with a predetermined threshold value to determine if an acceleration has actually occurred. As a result, the threshold value is large enough that it will not detect a slight change in the degree of opening of the throttle valve during the steady running state of the engine, but can rapidly detect a mild acceleration condition. As shown in FIG. 10(*a*), line 161 shows changes in the degree of opening TA of the throttle valve during a mild acceleration condition. A throttle valve degree change rate DLTA as difference of value of TA between adjacent sampling periods of 16 milliseconds is calculated from the line 161. In FIG. 10(*b*), line 163 shows a change in the value of the accumulation value SDLTA as a summation of value of the throttle valve degree change rate DLTA from the start of the acceleration condition as shown by line 161. Line 165 is a threshold value for a determination of the mild acceleration condition to carry out an acceleration condition fuel enrichment process. Therefore, an acceleration condition can be detected at point 1, as circled, at which the accumulated value SDLTA exceeds the threshold value determined by line 165. In FIG. 10(*a*), a dotted line 166 indicates changes in the throttle opening degree during a rapid acceleration condition. Line 167 indicates a change in the accumulation value SDLTA corresponding to line 166. In this case, the detection of an acceleration condition can be made at point 2, as circled. As will be clear from the above, the present invention enables a rapid detection of any kind of acceleration condition.

Further, the present invention can overcome the above-mentioned difficulty in that a correct detection of a mild acceleration condition is also obtained, for the following reason. In the prior art such as Japanese Unexamined Patent Publication No. 63-129140, to detect an acceleration condition first it is determined whether the updated value of the throttle opening degree TA is larger than a preceding value of the throttle opening degree TA0, a counter is incremented when the value TA is larger than TA0 and cleared when this requirement is not satisfied, and finally, an acceleration condition is determined when the value of the counter exceeds a predetermined value. Nevertheless, as well known to those skilled in this art, under a mild acceleration condition, the condition TA>TA0 is not always maintained during the entire period of an acceleration, due to noise caused by, for example, a slight change in the depression of an accelerator pedal by an operator, and as a result, sometimes the condition TA≦TA0 is obtained during the acceleration period, causing the counter to be cleared. Accordingly, the determining of an acceleration condition is delayed, and therefore, the detection of an acceleration condition is delayed.

Conversely, according to the present invention, the drawback in the prior art is overcome by obtaining an acceleration change rate accumulation value SDLTA. In FIG. 10(*a*), assuming that there is a rapid drop of detected value of the throttle opening TA during an acceleration at 3, as circled. In this case, at that instant the difference value DLTA would have a zero value, but the accumulation value SDLTA is maintained. As a result, a quick detection of the acceleration is obtained at point 3', as circled. This means that a quick detection of the acceleration is possible even if there is a temporary occurrence of a condition of TA ≦TA0 during the accumulation period.

Furthermore, when noise occurs during a steady running state at point 4, as circled, where the difference DLTA (=TA−TA0) temporarily would have a large value at that instant, at the following sampling timing at 4', as circled, the accumulation value SDLTA is returned to the value (zero) as before, which prevents an erroneous detection of an acceleration condition due to an occurrence of noise. When a coincidence exists between the timing of generation of the noise and the occurrence of the beginning of the new sampling period, the large difference value TA0 is maintained and the accumulated value is cleared at step 212, so that the accumulation value SDLTA obtained at the following step has a large value, to thereby cause an erroneous acceleration detection. Nevertheless, this coincidence between the timings of a generation of noise and the occurrence of the beginning of the new sampling period occurs very rarely, and thus does not present a problem.

Figure 11:
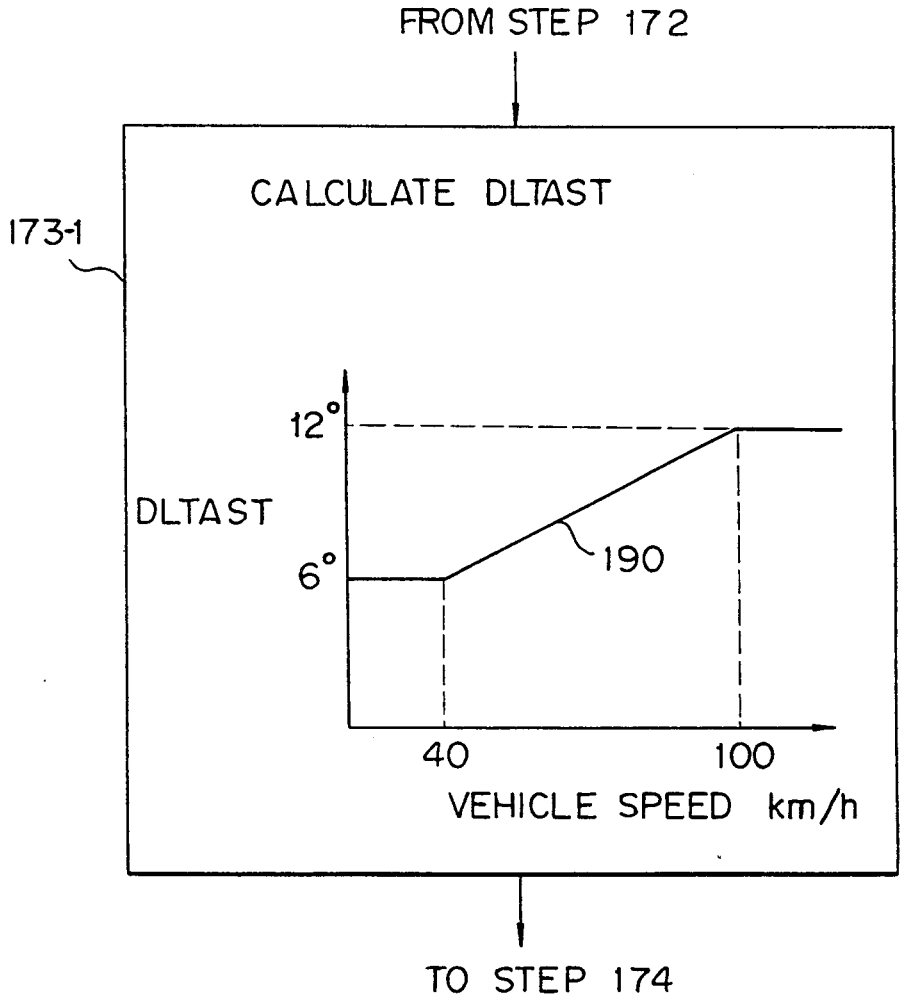

In the first embodiment, the threshold value of throttle valve opening degree change rate accumulation value SDLTA for determining the acceleration has a fixed value of 7.5 degrees in step 174 in FIG. 7. Contrary to this, in the second embodiment shown in FIG. 11, this threshold value is changed in accordance with an increase in a vehicle speed. FIG. 11 shows only a block 173-1, which is used as step 173 in FIG. 7. In FIG. 11, line 190 indicates a desired relationship between the vehicle speed and the threshold value DLTAST. As will be understood, the threshold value DLTAST is increased in accordance with an increase in the value of the vehicle speed. A data map of the values of the threshold value DLTAST with respect to values of the vehicle speed corresponding thereto is provided in a read only memory (ROM) in the control circuit 50. At step 173-1, in place of step 173 in FIG. 7, a value of the vehicle speed is detected by a vehicle speed sensor 300 (FIG. 1), and a well known interpolation calculation is carried out to obtain a value of the threshold DLTAST corresponding to the sensed vehicle speed. At the execution of step 174, this interpolated value of DLTAST is used for determining the acceleration condition for which the lean air-fuel ratio control should be cancelled, such that the threshold level DLTAST is increased in accordance with the increase in the vehicle speed. Namely, the threshold has a small value when the vehicle speed is low, and thus the air-fuel ratio is quickly controlled to a value by which a high engine output is obtained in accordance with the acceleration requirement by the driver. Contrary to this, when the vehicle speed is high, the threshold level becomes high, and thus a wide lean air-fuel ratio control zone is obtained. As a result, this second embodiment can meet a requirement for an acceleration performance and a requirement for a high fuel consumption efficiency, which are contradictory.

Figure 12:
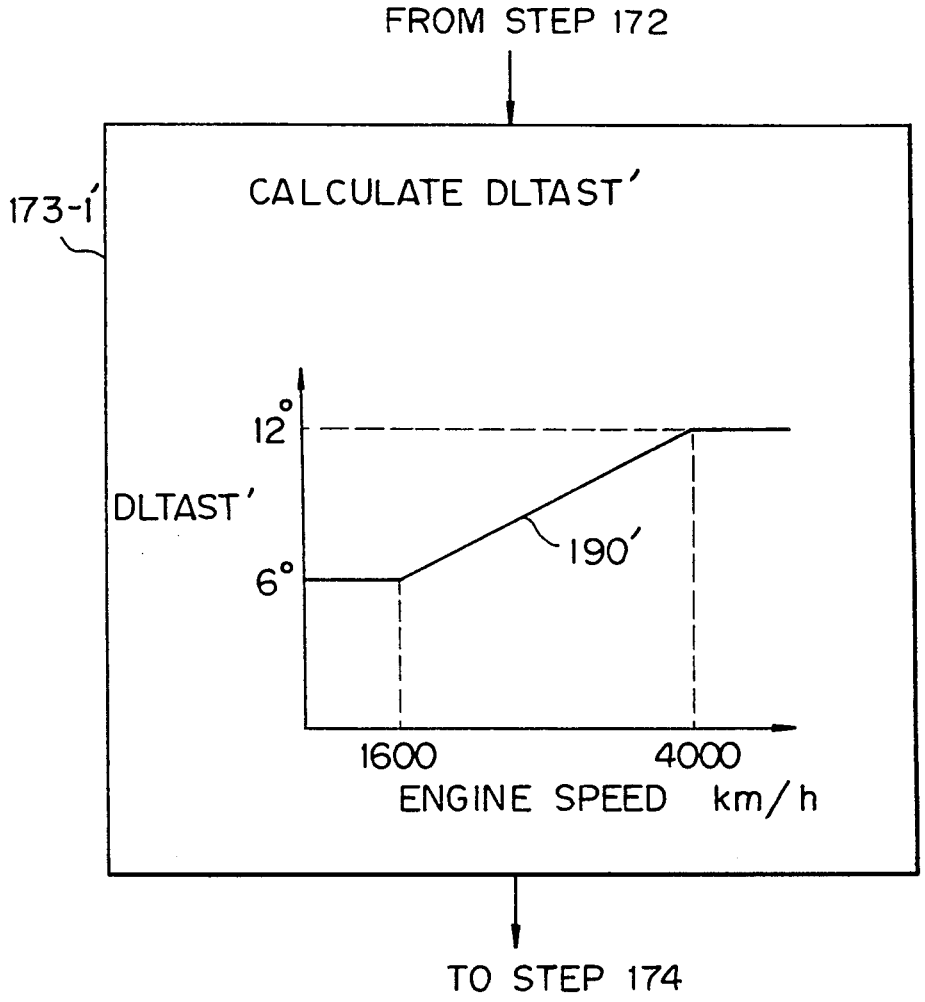

In FIG. 12 the vehicle speed in the embodiment in FIG. 11 is replaced by an engine speed. FIG. 12 shows only a block 173-1', which is used as step 173 in FIG. 7. Similar to FIG. 11, line 190' indicates a desired relationship between the engine speed and the threshold value DLTAST'. The threshold value DLTAST' is increased in accordance with an increase in the value of the engine speed. A data map of the values of the threshold value DLTAST' with respect to engine speed values corresponding thereto is provided in a read only memory (ROM) in the control circuit 50. At step 173-1', in place of step 173 in FIG. 7, a value of the engine speed is detected by an engine speed sensor 302 in FIG. 1, and an interpolation calculation is carried out to obtain a value of the threshold DLTAST corresponding to the sensed engine speed.

Note, instead of detecting the rate of change of the engine load by the rate of change in the throttle opening degree, as in the above embodiments, a rate of change in the intake pressure or a rate of change in the ratio of an intake air flow amount to an engine speed can be detected.

Although the present invention is described with reference to embodiments, many changes can be made by those skilled in this art without departing from the scope and spirit of the present invention.

I claim:

1. An internal combustion engine, comprising:

an engine body;

an intake system connected to the engine body for an introduction of an amount of intake air to the engine body;

an exhaust system connected to the engine body for a removal of a resultant exhaust gas from the engine body;

for introducing an amount of fuel into a flow of an intake air at a predetermined timing in one complete engine cycle to obtain a combustible mixture to be introduced into the engine;

means for controlling the air-fuel ratio of the combustible mixture in the intake system by controlling said amount of fuel first air-fuel ratio setting means for setting said air-fuel ratio to the lean mixture side;

second air-fuel ratio setting means for setting said air-fuel ratio to obtain an engine power;

means for detecting a load of the engine;

first calculating means for calculating a rate of change in the engine load during a first period short enough for a detection of a change in the engine load during a slight acceleration condition;

second calculating means for consecutively calculating an accumulated value of values of a rate of change in the engine load in a predetermined second period;

means, based on the calculated accumulated value, for determining an acceleration operation of the engine; and switching means for switching a connection of the air-fuel ratio control means from the first setting means to said second setting means when the acceleration operation is determined.

2. An internal combustion engine according to claim 1, wherein said determining means comprise means for setting a predetermined threshold value, and means for comparing the accumulated value with said threshold value for determining an occurrence of an acceleration when the accumulated value is larger than the threshold value.

3. An internal combustion engine according to claim 2, wherein said setting means comprise a map of threshold values with respect to values of an engine operating condition, detecting means for detecting the engine operating condition, and means for interpolating from the map a threshold value corresponding to the detected engine operating condition.

4. An internal combustion engine according to claim 3, wherein said engine operating condition is a vehicle speed.

5. An internal combustion engine according to claim 3, wherein said engine operating condition is an engine rotational speed.

6. An internal combustion engine according to claim 1, further comprising swirl control means responsive to engine operating condition for switching between a condition at which a swirl movement of the combustible mixture is obtained when the air-fuel ratio is controlled to the lean side, and a condition in which no swirl movement occurs when the air-fuel ratio is controlled to the engine output power air-fuel ratio.

7. An internal combustion engine according to claim 1, wherein said air-fuel ratio control means comprise a sensor for detecting an air-fuel ratio, and a feedback means for generating a signal to make the detected air-fuel ratio equal to the set air fuel ratio.

8. An internal combustion engine according to claim 1, wherein said load of the engine detected by said means for detecting a load of the engine is a degree of opening of a throttle valve in said intake system.

9. An internal combustion engine according to claim 1, further comprising means for holding said connection of the air-fuel ration setting means to said second setting means once said switching has occurred and until a deceleration is detected.

10. An internal combustion engine, comprising:

an engine body;

an intake system connected to the engine body for an introduction of an amount of intake air to the engine body;

an exhaust system connected to the engine body for a removal of a resultant exhaust gas from the engine body;

means for introducing an amount of fuel into a flow of an intake air at a predetermined timing in one complete engine cycle to obtain a combustible mixture to be introduced into the engine;

means for controlling the air-fuel ratio of the combustible mixture in the intake system by controlling said amount of fuel;

first air-fuel ratio setting means for setting said air-fuel ratio to the lean mixture side;

second air-fuel ratio setting means for setting said air-fuel ratio to obtain an engine power;

first switching means, responsive to the engine operating condition, for switching the connection of the air-fuel ration control means between the first and second air-fuel ratio setting means;

means provided in the intake system for selectively generating a swirl movement of the combustible mixture;

means responsive to the engine operating condition for operating the swirl means so that the swirl movement is obtained when the air-fuel ratio is controlled to the lean mixture side;

means for detecting a load of the engine;

first calculating means for calculating a rate of change in the engine load during a first period short enough for a detection of a change in the engine load during a slight acceleration;

second calculating means for calculating consecutively an accumulated value of values of a rate of change in the engine load in a predetermined second period;

means, based on the calculated accumulated value, for determining an acceleration operation of the engine; and second switching means, overriding the operation of the first switching means, for switching a connection of the air-fuel ratio control means from the first setting means to said second setting means when the acceleration operation is determined.

11. An internal combustion engine according to claim 10, wherein said determining means comprise means for setting a predetermined threshold value, and means for comparing the accumulated value with said threshold value for determining an occurrence of an acceleration when the accumulated value is larger than the threshold value.

12. An internal combustion engine according to claim 11, wherein said setting means comprise a map of threshold values with respect to values of an engine operation condition, detecting means for detecting an engine operation condition, and means for interpolating from the map a threshold value corresponding to the detected engine operating condition.

13. An internal combustion engine according to claim 12, wherein said engine operating condition is a vehicle speed.

14. An internal combustion engine according to claim 12, wherein said engine operating condition is an engine rotational speed.

* * * * *

UNITED STATES PATENT AND TRADEMARK OFFICE

CERTIFICATE OF CORRECTION

PATENT NO. : 5,056,491

DATED : October 15, 1991

INVENTOR(S) : Keisuke TSUKAMOTO

It is certified that error appears in the above-identified patent and that said Letters Patent is hereby corrected as shown below:

Column 5, line 26, delete "a" before "for".

Column 5, line 42, insert to-- between "falls" and "the".

Column 6, line 18, delete "be" between "should" and "also".

Column 6, line 58, change "predetermine" to --predetermined-- and insert --position--right after.

Column 7, line 39, change "e,uns/V/" to --V--.

Column 7, line 43, change "e,uns/V/" to --V--.

Column 9, line 9, change "O" to --0--.

Column 9, line 48, change "$0_2$" to --$O_2$--.

Column 9, line 57, change "$P_3$and" to --$P_3$ and--.

Column 10, line 8, insert --be-- after "will".

Column 10, line 38, change "a" to --an--.

Column 10, line 66, change "$N_2$at" to --$N_2$ at--.

UNITED STATES PATENT AND TRADEMARK OFFICE

CERTIFICATE OF CORRECTION

PATENT NO. : 5,056,491

DATED : October 15, 1991

INVENTOR(S) : Keisuke TSUKAMOTO

It is certified that error appears in the above-identified patent and that said Letters Patent is hereby corrected as shown below:

Column 11, line 14, delete "is" at the end of the line.

Column 12, line 5, change "an" to --a--.

Column 13, line 2, after "condition" insert a comma.

Column 14, line 55, insert --means-- before "for".

Column 16, line 54, change "operation" to --operating--.

Signed and Sealed this

Sixth Day of April, 1993

*Attest:*

STEPHEN G. KUNIN

*Attesting Officer*

*Acting Commissioner of Patents and Trademarks*